US005703020A

United States Patent [19]

Das

[11] Patent Number: 5,703,020

[45] Date of Patent: Dec. 30, 1997

[54] HIGH TC SUPERCONDUCTING FERROELECTRIC MMIC PHASE SHIFTERS

[76] Inventor: Satyendranath Das, P.O. Box 574, Mt. View, Calif. 94042-0574

[21] Appl. No.: 606,014

[22] Filed: Feb. 12, 1996

Related U.S. Application Data

[63] Continuation of Ser. No. 39,428, May 30, 1995, abandoned.

[51] Int. Cl.[6] ..... H01P 9/00; H01B 12/02

[52] U.S. Cl. ..... 505/210; 505/700; 505/701; 505/866; 333/995; 333/161; 333/205

[58] Field of Search ..... 333/161, 995, 333/204, 205; 505/210, 700, 701, 866

[56] References Cited

U.S. PATENT DOCUMENTS 5,451,567 9/1995 Das ..... 333/995 X
5,496,795 3/1996 Das ..... 333/995 X

FOREIGN PATENT DOCUMENTS 4013028 6/1994 WIPO ..... 333/995

OTHER PUBLICATIONS

Lee, Y.S. "14–GeHz MIC16–ns Delay Filter for Differentially Coherent QPSK Regenerative Repeater", *197E IEEE MIT–S Int'l Microwave Symposium*, Ottawa, Canada, (27–29 Jan. 1978) pp. 37–40.

Varandan et al., "A Novel Microwave Planar Phase Shifter", *Microwave Journal*, Apr. 1995, pp. 244, 248, 250, 253, 254.

*Primary Examiner*—Benny T. Lee

[57] ABSTRACT

A MMIC high Tc superconducting ferroelectric phase shifter is comprised of as microstrip line on a film of a single crystal ferroelectric material. To operate the phase shifter over a desired bandwidth a quadrature band pass filter, having 1,2,3, . . . coupled lines, is coupled to the phase shifter. The microstrip lines are comprised of a high Tc superconductor such as YBCO, TBCCO.

20 Claims, 3 Drawing Sheets

HIGH TC SUPERCONDUCTING FERROELECTRIC MMIC PHASE SHIFTERS

This application is a continuation of Ser. No. 29/039,428, now abandoned. The detailed description of the preferred embodiment is identical to that presented in the referenced application.

FIELD OF INVENTION

The present invention relates to phase shifters of electromagnetic waves.

DESCRIPTION OF THE PRIOR ART

In many fields of electronics, it is often necessary to change the phase of signals. Commercial phase shifters are available. In the U.S. Pat. No. 5,496,795 it is stated that ferroelectric materials have a number of attractive properties. Ferroelectrics can handle high peak power. The average power handling capability is governed by the dielectric loss of the material. They have low switching time (such as 100 nS). Some ferroelctrics have low losses. The permittivity of ferroelectrics is generally large, and as such the device is small in size. The ferroelectrics are operated in the paraelectric phase, i.e. slightly above the Curie temperature. The active part of the ferroelectric high Tc superconductor phase shifter can be made of thin films, and can be integrated with other monolithic microwave/RF devices. Inherently they have a broad bandwidth. They have no low frequency limitation as contrasted with ferrite devices. The high frequency operation is governed by the relaxation frequency, such as 95 GHz for strontium titanate, of the ferroelectric material. The loss of the ferroelectric high Tc superconductor RF phase shifter is low for ferroelectric materials with a low loss tangent. A number of ferroelectric materials are not subject to burnout. Depending on trade off studies in an individual case, the best type of phase shifter can be selected.

One object of this invention is to design a phase shifter whose bandwidth is defined by a band pass filter.

In U.S. Pat. No. 5,459,123 to Das, it is stated that Das used a composition of polycrystalline barium titanate, of stated Curie temperature being 20 degrees C. and of polythene powder in a cavity and observed a shift in the resonant frequency of the cavity with an applied bias voltage based on S. Das, "Quality of a Ferroelectric Material," IEEE Trans. MTT-12, pp. 440–448, July 1964.

In U.S. Pat. No. 5,496,795 to Das, it is stated that Das discussed operation, of microwave ferroelectric devices, slightly above the Curie temperature, to avoid hysterisis and showed the permittivity of a ferroelectric material to be maximum at the Curie temperature and the permittivity to reduce in magnitude as one moves away from the Curie temperature based on S. Das, "Quality of a Ferroelectric Material," IEEE Trans. MTT-12, pp. 440–445, Jul. 1964. In the above mentioned U.S. Pat. No. 5,496,795, it is stated that another object of this design is to design phase shifters to handle power levels of at least 0.5 Megawatt based on G. Shen, C. Wilker, P. Pang and W. L. Holstein," High Tc Superconducting-sapphire Microwave resonator with Extremely High Q-Values Up To 90K," IEEE MTT-S Digest, pp. 193–196, 1992.

SUMMARY OF THE INVENTION

A high temperature superconducting MMIC ferroelectric phase shifter is comprised of a film of a single crystal ferroelectric material. The phase shifter is coupled to a quadrature filter having 1, 2, 3, . . . n coupled lines. A quarter wavelength portion, at an operating frequency of the phase shifter, of the phase shifter microstrip line is edge coupled to a half wavelength microstrip line. A first quarter wavelength portion of the one-half wavelength microstrip line being coupled to the phase shifter, the remaining quarter wavelength portion being coupled to the adjacent coupled line. At the other end of the phase shifter, a quarter wavelength line is edge coupled to the phase shifter. A bias voltage applied to the phase shifter microstrip line is isolated from the input and output microwave circuits. For matching the low impedance of the microstrip lines, a respective quarter wave matching transformer is used both at the input and the output of the combined phase shifter. All the microstrip lines are comprised of films of a single crystal high Tc superconductor. The bottom side of the ferroelectric film is a sheet of a single crystal high Tc superconductor.

With these and other objectives in view, as will hereinafter be more particularly pointed out in detail in the appended claims, reference is now made to the following description taken in connection with the accompanying diagrams.

DETAILED DESCRIPTION OF THE PREFERRED EMBODIMENT

Figure 1:
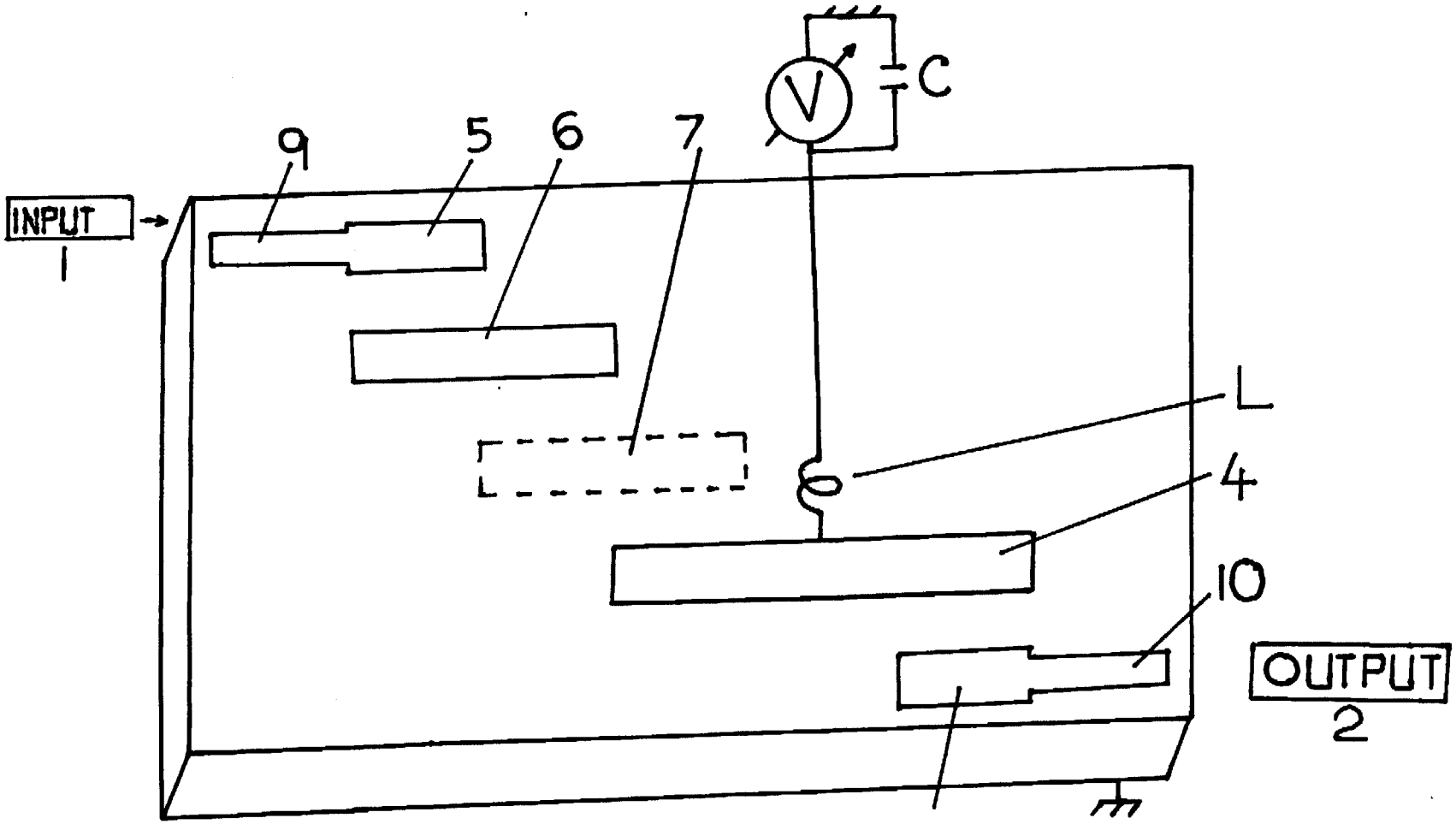
FIG. 1 depicts a high Tc superconducting MMIC ferroelectric phase shifter.
Figure 2:
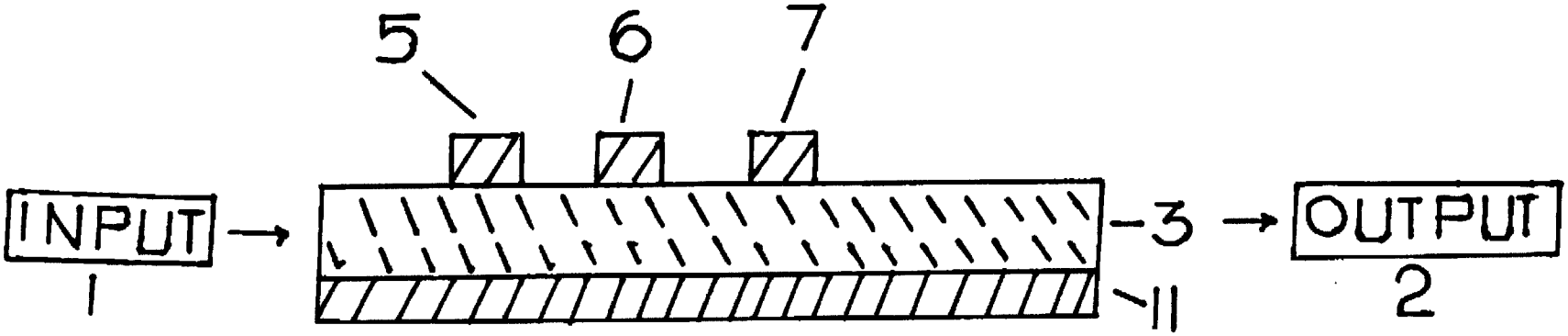
FIG. 2 depicts a transverse cross-section of the MMIC ferroelectric phase shifter shown in FIG. 1.

FIG. 1 depicts an embodiment of my invention, a high Tc superconducting MMIC ferroelectric phase shifter. A film of a single crystal ferroelectric, such as $KTa_{1-x}Nb_xO_3$ or $Sr_{1-x}Pb_xTiO_3$ where the value of x varies between 0.005 and 0.7, is designated as reference label 3. A phase shifter element is comprised of a microstrip line 4. A variable bias voltage V is connected to the microstrip line 4. An inductance L provides a high impedance at an operating frequency of the phase shifter. A capacitance C provides a short circuit to any RF energy present after the inductance L. Upon the application of a bias voltage V, the permittivity of the ferroelectric film under the microstrip line 4 changes, changing the electrical length of the microstrip line 4 and, thus, introducing a differential phase shift. A quarter wavelength, at an operating frequency of the phase shifter, microstrip line 5 is edge coupled to an adjacent half wavelength, microstrip line 6. A quarter wave portion of a half wavelength microstrip line 7, shown dotted, is edge coupled to the adjacent remaining quarter wavelength portion of the microstrip line 6. The remaining quarter wavelength portion of the microstrip line 7 is edge coupled to the phase shifter element 4. Only three coupled lines, 5, 6, and 7, are shown. In practice, 1, 2, 3... n coupled lines are used depending on the required bandwidth of the phase shifter. A quarter wavelength, at an operating frequency of the phase shifter, microstrip line 8 is edge coupled to the phase shifter. Because of the generally high permittivity of the ferroelectric film, the impedance of the microstrip lines are low. For matching the impedance of the microstrip line 5 to an impedance of the input circuit of the phase shifter, a quarter wavelength, at an operating frequency of the phase shifter, impedance matching transformer 9 is used. For matching the impedance of the microstrip line 8 to an impedance of the output circuit of the phase shifter, a quarter wavelength, at an operating frequency of the phase shifter, impedance matching transformer 10 is used. The input is 1 and the output is 2. The d.c. bias voltage V is isolated from the input and output circuits. All the microstrip lines are comprised of films of a single crystal high Tc superconductor such as YBCO or TBCCO. The bottom side of the ferroelectric film 3 has a ground plane sheet 11 of a single crystal high Tc superconductor such as YBCO or TBCCO as shown in FIG. 2. The MMIC phase shifter is operated at a high Tc superconducting temperature slightly above the Curie temperature of the ferroelectric film 3.

FIG. 2 depicts a transverse cross-section of the MMIC phase shifter shown in FIG. 1. A sheet of a single crystal high Tc superconductor, such as YBCO or TBCCO, is designated by reference lable 11. On top of the single crystal high Tc superconductor 11 is deposited a film of a single crystal ferroelectric such as $KTa_{1-x}Nb_xO_3$, or $Sr_{1-x}Pb_xTiO_3$ where the value of x varies between 0.005 and 0.7. On top of the ferroelectric film 3 is deposited edge coupled microstrip lines 5, 6 and 7. All microstrip lines are comprised of films of a single crystal high Tc superconductor such as YBCO or TBCCO INPUT is 1 and OUTPUT is 10.

Figure 3:
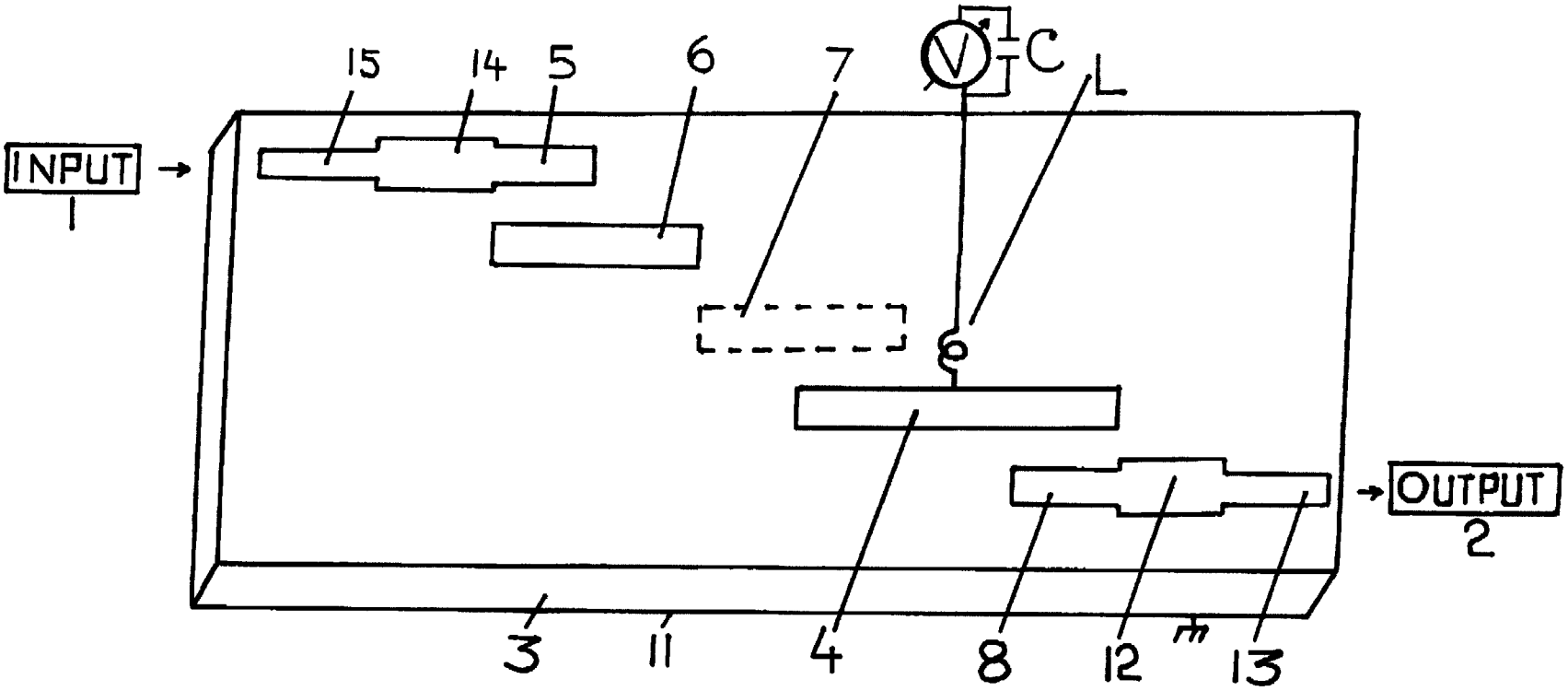
FIG. 3 depicts another embodiment of a high Tc superconducting MMIC ferroelectric phase shifter.

FIG. 3 depicts another embodiment of my invention, a high Tc superconducting MMIC ferroelectric phase shifter. The same label numbers refer to the same elements of FIG. 1 and are not all described herein. For broadening the bandwidth of the matching transformers two sections of matching transformers are used. For matching the impedance of the microstrip line 5 to an input circuit 1 of the phase shifter, two sections 14 and 15 of microstrip lines, each quarter wavelength at an operating frequency of the phase shifter, are used as matching transformers. For matching the impedance of the microstrip line 8 to an output circuit 2 of the phase shifter, two sections 12 and 13 of microstrip lines, each quarter wavelength at an operating frequency of the phase shifter, are used as matching transformers. All microstrip lines are comprised of films of a single crystal high Tc superconductor such as YBCO or TBCCO. The MMIC phase shifter is operated at a high superconducting temperature slightly above the Curie temperature of the ferroelectric film.

In another embodiment of my invention, the ferroelectric element 3 of FIG. 1, FIG. 2 and FIG. 3 is a sheet of a single crystal ferroelectric material such as $KTa_{1-x}Nb_xO_3$, or $Sr_{1-x}Pb_xTiO_3$ where the value of x varies between 0.005 and 0.7. In another embodiment of my invention, the ferroelectric element 3 of FIG. 1, FIG. 2 and FIG. 3 is a ferroelectric liquid crystal (FLC).

It should be understood that the foregoing disclosure relates to only typical embodiment of this invention and that numerous modifications or alternatives may be made therein by those of ordinary skill without departing from the spirit and scope of the inventions set forth in the appended claims. All ferroelectric materials, all compositions of ferroelectric materials and polythene, all high Tc superconductors, all frequencies, all impedances of microstrip lines, all thickness of films are contemplated in this invention.

What is claimed is:

1. A MMIC ferroelectric high Tc superconducting phase shifter, having an input, an output, a ground plane, a band pass filter, a single crystal ferroelectric material having an electric field dependent permittivity, a Curie temperature and comprised of:

said ground plane being a sheet of a single crystal high Tc superconductor;

said single crystal ferroelectric material comprised of a single crystal ferroelectric film deposited on the said ground plane;

a first microstrip line being disposed on said single crystal ferroelectric film to provide a phase shift;

said band pass filter comprising of second, third, fourth, . . . . (n−1), n, microstrip lines;

said second microstrip line being disposed on said single crystal ferroelectric film being one half wavelength long, at said operating frequency of the phase shifter, and said second microstrip line having a first one quarter wavelength portion thereof being edge coupled to and separate from an input end of the first microstrip line and having a remaining second quarter wavelength portion being coupled to and separate from the following said third microstrip line;

said third, fourth . . . (n−1)th microstrip lines respectively disposed on said single crystal ferroelectric film each one of said third, fourth . . . (n−1)th microstrip lines respectively being one half wavelength long, at said operating frequency of the phase shifter, having a first one quarter wavelength portion thereof being edge coupled to and separate from previous ones of the third, fourth (n−1)th microstrip lines and having a remaining second quarter wavelength portion thereof being coupled to and being separate from a succeeding one of the third, fourth (n−1)th microstrip lines;

said nth microstrip line disposed on said single crystal ferroelectric film being one quarter wavelength long, at said operating frequency of the phase shifter, said nth microstrip line being coupled to and being separate from the (n−1)th microstrip line;

an input transformer, being quarter wavelength long at said operating frequency of the phase shifter, and comprised of microstrip conductors on said single crystal ferroelectric film of the phase shifter, said input transformer being connected to and being a part of the nth microstrip line for matching an impedance of an input circuit of the phase shifter to an impedance of the phase shifter;

a first transmission means for coupling energy from the input circuit into said input transformer;

a (n+1)th microstrip line disposed on said single crystal ferroelectric film being one quarter wavelength long, at said operating frequency of the phase shifter, said (n+1)th microstrip line being coupled to and being separate from an output end of the first microstrip line;

an output transformer, being quarter wavelength long at said operating frequency of the phase shifter, and comprised of microstrip conductors on said single crystal ferroelectric film of the phase shifter, said output transformer being connected to and being a part of the (n+1)th microstrip line for matching an impedance of an output circuit of the phase shifter to an impedance of said phase shifter;

a second transmission means for coupling energy from said output transformer into the output circuit;

voltage means for applying a bias voltage to the first microstrip line;

said first, second . . . nth, (n+1)th microstrip lines being respectively comprised of a film of a single crystal high Tc superconductor; and means for operating said phase shifter at a high Tc superconducting temperature slightly above the Curie temperature associated with the single crystal ferroelectric film to avoid hysterisis and to provide a maximum change of the permittivity of said single crystal ferroelectric film of the phase shifter.

2. A MMIC ferroelectric high Tc superconducting phase shifter of claim 1; wherein the single crystal high Tc superconductor being YBCO.

3. A MMIC ferroelectric high Tc superconducting phase shifter of claim 1; wherein the single crystal ferroelectric being $Sr_{1-x}Pb_xTiO_3$.

4. A MMIC ferroelectric high Tc superconducting phase shifter of claim 1; wherein the single crystal ferroelectric being KTN.

5. A MMIC ferroelectric high Tc superconducting phase shifter of claim 1; wherein the single crystal high Tc superconductor being YBCO and the single crystal ferroelectric being $Sr_{1-x}Pb_xTiO_3$.

6. A MMIC ferroelectric high Tc superconducting phase shifter of claim 1; wherein the single crystal high Tc superconductor being YBCO and the single crystal ferroelectric being KTN.

7. A MMIC ferroelectric high Tc superconducting phase shifter of claim 1; wherein the single, crystal high Tc superconductor is TBCCO and the single crystal ferroelectric is KTN.

8. A MMIC ferroelectric high Tc superconducting phase shifter of claim 1; wherein the single crystal high Tc superconductor is TBCCO and the single crystal ferroelectric is $Sr_{1-x}Pb_xTiO_3$.

9. A MMIC ferroelectric high Tc superconducting phase shifter of claim 1; wherein the phase shifter is a MMIC.

10. A MMIC ferroelectric high Tc superconducting phase shifter, having an input, an output, a ground plane, a band pass filter, a single crystal ferroelectric material having an electric field dependent permittivity, a Curie temperature and comprised of:

said ground plane being a sheet of a single crystal high Tc superconductor;

said single crystal ferroelectric material comprised of a single crystal ferroelectric film deposited on said ground plane;

a first microstrip line being disposed on said ferroelectric film to provide a phase shift;

said band pass filter comprising of second, third, fourth, . . . (n−1), n, microstrip lines;

said second microstrip line being disposed on said ferroelectric film being one half wavelength long, at said operating frequency of the phase shifter, and said second microstrip line having a first one quarter wavelength portion thereof being edge coupled to and separate from an input end of said first microstrip line and having a remaining second quarter wavelength portion being coupled to and separate from the following said third microstrip line;

said third, fourth . . . (n−1)th microstrip lines respectively disposed on said ferroelectric film each one of said third, fourth . . . (n−1)th microstrip lines respectively being one half wavelength long, at said operating frequency of the phase shifter, having a first one quarter wavelength portion thereof being edge coupled to and separate from previous one of the third, fourth (n−1)th microstrip lines and having a remaining second quarter wavelength portion thereof being coupled to and being separate from a succeeding one of the third, fourth (n−1)th microstrip line;

said nth microstrip line disposed on said ferroelectric film and being one quarter wavelength long, at said operating frequency of the phase shifter, said nth microstrip line being coupled to and being separate from the (n−1)th microstrip line;

an input two-section transformer, respectively being quarter wavelength long at said operating frequency of the phase shifter, and comprised of microstrip conductors on said ferroelectric film of said phase shifter, said input two sections transformer being connected to and being a part of said nth microstrip line for matching an impedance of an input circuit of said phase shifter to an impedance of said phase shifter;

a first transmission means for coupling energy from said input circuit into said input two sections transformer;

a (n+1)th microstrip line disposed on said ferroelectric film being one quarter wavelength long, at said operating frequency of said phase shifter, said (n+1)th microstrip line being coupled to and being separate from an output end of said first microstrip line;

an output two-section transformer, respectively being quarter wavelength long at said operating frequency of said phase shifter, and comprised of microstrip conductors on said ferroelectric film of said phase shifter, said output two sections transformer being connected to and being a part of the (n+1)th microstrip line for matching an impedance of an output circuit of said phase shifter to an impedance of said phase shifter;

a second transmission means for coupling energy from said output two sections transformer into the output circuit;

voltage means for applying a bias voltage to the first microstrip line;

said first, second . . . nth, (n+1)th microstrip lines being respectively comprised of a film of a single crystal high Tc superconductor; and means for operating said phase shifter at a high Tc superconducting temperature slightly above the Curie temperature associated with said ferroelectric film to avoid hysteresis and to provide a maximum change of the permittivity of said ferroelectric film of said phase shifter.

11. A MMIC ferroelectric high Tc superconducting phase shifter of claim 10; wherein the single crystal high Tc superconductor being YBCO and the single crystal ferroelectric being KTN.

12. A MMIC ferroelectric high Tc superconducting phase shifter of claim 10; wherein the single crystal high Tc superconductor is TBCCO and the single crystal ferroelectric is KTN.

13. A MMIC ferroelectdc high Tc superconducting phase shifter of claim 10; wherein the single crystal high Tc superconductor is TBCCO and the single crystal ferroelectric is $Sr_{1-x}Pb_xTiO_3$.

14. A MMIC ferroelectric high Tc superconducting phase shifter of claim 10; wherein said phase shifter is a MMIC.

15. A ferroelectric high Tc superconducting phase shifter, having an input, an output, a ground plane, a band pass filter, a single crystal ferroelectric material having an electric field dependent permittivity, a Curie temperature and comprised of:

a first microstrip line being disposed on said single crystal ferroelectric material to provide a phase shift;

said band pass filter comprising of second, third, fourth, . . . (n−1), n, microstrip lines;

said second microstrip line being disposed on said ferroelectric material being one half wavelength long, at said operating frequency of said phase shifter, and said second microstrip line having a first one quarter wavelength portion thereof being edge coupled to and separate from an input end of the said first microstrip line and having a remaining second quarter wavelength portion being coupled to and separate from the following said third microstrip line;

said third, fourth . . . (n−1)th microstrip lines respectively disposed on said ferroelectric material each one of said third, fourth . . . (n−1)th microstrip lines respectively being one half wavelength long, at said operating frequency of said phase shifter, having a first one quarter wavelength portion thereof being edge coupled to and separate from previous one of the third, fourth (n−1)th microstrip lines and having a remaining second quarter wavelength portion thereof being coupled to and being separate from a succeeding one of the third, fourth (n−1)th microstrip lines;

said nth microstrip line disposed on said ferroelectric material and being one quarter wavelength long, at said operating frequency of said phase shifter, said nth microstrip line being coupled to and being separate from the (n−1)th microstrip line;

an input transformer, being quarter wavelength long at said operating frequency of said phase shifter, and comprised of microstrip conductors on said ferroelectric material of said phase shifter, said input transformer being connected to and being a part of said nth microstrip line for matching an impedance of an input circuit of said phase shifter to an impedance of said phase shifter;

a first transmission means for coupling energy from the input circuit into said input transformer;

a (n+1)th microstrip line disposed on said ferroelectric material being one quarter wavelength long, at said operating frequency of said phase shifter, said (n+1)th microstrip line being coupled to and being separate from an output end of said first microstrip line;

an output transformer, being quarter wavelength long at said operating frequency of said phase shifter, and comprised of microscript conductors on said ferroelectric material of said phase shifter, said output transformer being connected to and being a part of said (n+1)th microstrip line for matching an impedance of an output circuit of said phase shifter to an impedance of said phase shifter;

a second transmission means for coupling energy from said output transformer into the output circuit;

a film of a single crystal high Tc superconductor being deposited on the reverse side of said single crystal ferroelectric and being connected to the plane ground;

voltage means for applying a bias voltage to the first microstrip line;

said first, second . . . nth, (n+1)th microstrip lines being respectively comprised of a film of a single crystal high Tc superconductor; and means for operating said phase shifter at a high Tc superconducting temperature slightly above the Curie temperature associated with said single crystal ferroelectric material to avoid hysteresis and to provide a maximum change of the permittivity of said ferroelectric material of said phase shifter.

16. A ferroelectric high Tc superconducting phase shifter of claim 15; wherein the single crystal high Tc superconductor being YBCO.

17. A ferroelectric high Tc superconducting phase shifter of claim 15; wherein the single crystal ferroelectric being $Sr_{1-x}Pb_xTIO_3$.

18. A ferroelectric high Tc superconducting phase shifter of claim 15; wherein the single crystal ferroelectric being KTN.

19. A ferroelectric high Tc superconducting phase shifter of claim 15; wherein the single crystal high Tc superconductor being YBCO and the single crystal ferroelectric being $Sr_{1-x}Pb_xTiO_3$.

20. A MMIC ferroelectric high Tc superconducting phase shifter of claim 15; wherein the single crystal high Tc superconductor being YBCO and the single crystal ferroelectric being KTN.

* * * * *